US005501931A

United States Patent [19]

Hirama et al.

[11] Patent Number: 5,501,931

[45] Date of Patent: Mar. 26, 1996

[54] TONER FOR FLASH FIXATION

[75] Inventors: Kazuhiro Hirama; Mikio Uno, both of Kanagawa, Japan

[73] Assignee: Mitsubishi Kasei Corporation, Tokyo, Japan

[21] Appl. No.: 291,510

[22] Filed: Aug. 18, 1994

[30] Foreign Application Priority Data

| | | | |
|---|---|---|---|
| Aug. 18, 1993 | [JP] | Japan | 5-204232 |
| Aug. 18, 1993 | [JP] | Japan | 5-204233 |
| Mar. 28, 1994 | [JP] | Japan | 6-057256 |

[51] Int. Cl.[6] ..... G03G 13/20; G03G 9/08

[52] U.S. Cl. ..... 430/109; 430/124

[58] Field of Search ..... 430/110, 109, 430/904, 124

[56] References Cited

U.S. PATENT DOCUMENTS

| | | | |
|---|---|---|---|
| 4,386,147 | 5/1983 | Seimiya et al. | 430/99 |
| 4,486,524 | 12/1984 | Fujisaki et al. | 430/109 |
| 4,499,168 | 2/1985 | Mitsuhashi | 430/99 |
| 4,626,488 | 12/1986 | Inoue | 430/109 |
| 4,917,984 | 4/1990 | Saito | 430/109 |
| 5,084,368 | 1/1992 | Hirayama et al. | 430/109 |
| 5,264,311 | 11/1993 | Nakano et al. | 430/109 |
| 5,389,485 | 2/1995 | Katagiri et al. | 430/110 |

FOREIGN PATENT DOCUMENTS

| | | | |
|---|---|---|---|
| 0259819 | 3/1988 | European Pat. Off. . | |
| 0438181 | 7/1991 | European Pat. Off. . | |
| 0463822 | 1/1992 | European Pat. Off. . | |
| 0519715 | 12/1992 | European Pat. Off. . | |
| 0568309 | 11/1993 | European Pat. Off. . | |
| 0573705 | 12/1993 | European Pat. Off. . | |
| 55-6895 | 2/1980 | Japan | G03G 9/08 |
| 59-129862 | 7/1984 | Japan | G03G 9/08 |
| 63-32180 | 6/1988 | Japan | G03G 9/08 |
| 64-15752 | 1/1989 | Japan | G03G 9/08 |
| 1131575 | 5/1989 | Japan | G03G 9/08 |
| 1234857 | 9/1989 | Japan | G03G 9/08 |
| 222668 | 1/1990 | Japan | G03G 9/08 |
| 377962 | 4/1991 | Japan | G03G 9/087 |
| 4250464 | 9/1992 | Japan | G03G 9/087 |
| 4328576 | 11/1992 | Japan | G03G 9/08 |
| 5158280 | 6/1993 | Japan | G03G 9/087 |

OTHER PUBLICATIONS

Patent Abstracts of Japan, Abstract of JP–58–082258.
Patent Abstracts of Japan, Abstract of JP–59–129862.
Derwent Abstract of JP–4–190244.

*Primary Examiner*—John Goodrow
*Attorney, Agent, or Firm*—Sughrue, Mion, Zinn, Macpeak & Seas

[57] ABSTRACT

Disclosed is a toner for flash fixation which comprises: (i) a resin containing (a) a low molecular weight compound having the peak of molecular weight in 3,000 to 60,000 by gel permeation chromatography (GPC) and (b) a high molecular weight compound having the peak or shoulder of molecular weight in 80,000 to 1,000,000 by GPC, with the weight ratio of the low molecular weight to the high molecular weight compound in the range of 97 to 60/3 to 40 and (ii) a coloring material or a toner for flash fixation which comprises (i) a resin containing (a) a low molecular weight compound having the peak of molecular weight (Lp) in 3,000 to 60,000 by GPC, (b) a middle molecular weight compound having the peak of molecular weight (Mp) in 5,000 to 100,000 by GPC and (c) a high molecular weight compound having the peak of molecular weight (Hp) in 80,000 to 1,000,000 by GPC, with the condition of Lp<Mp<Hp and (ii) a coloring material, and a method for fixing a toner by flash fixation using these.

20 Claims, No Drawings

TONER FOR FLASH FIXATION

FIELD OF THE INVENTION

The present invention relates to a toner for flash fixation for developing an electrostatic latent image for use in electrophotography, etc.

BACKGROUND OF THE INVENTION

Hitherto, image fixing methods of a printing substrate in a printer using electrophotography have included a heat roller fixing method in which a printing paper is passed through heat rollers internally equipped with a motor lamp to pressurize a toner on the printing paper and an oven fixing method in which a printing paper is passed through an oven heated by infrared radiation. In these fixing methods, however, in cases where a printing paper is jammed in a fixing portion, there have been disadvantages in that a trace of pressure remains on the printing paper and the danger of fire is caused by high temperature heating.

Recently, to solve these disadvantages, a photofixing method, represented by a flash fixing method, has been put into practical use in a printer which may be used automatically for a long period of time, for instance, in output of computers. The flash fixing method is a method in which the fixation is conducted by a flash of a discharge tube such as xenon flash lamp and which flash fixing method is characterized in (1) less resolving degree deterioration on fixing due to non-contact fixation, (2) relatively short warm-up time, (3) less danger of fire on a printing paper jamming, and (4) fixing being possible almost irrespectively of the thickness and the kind of materials of a printing paper. In the flash fixing method, however, without controlling the irradiation period and method and the amount of a flash energy for a toner image and the heat decomposability and viscoelasticity of a toner, a bursting-like blank area, called "void phenomenon", is partly formed in a fixed image, whereby the image quality of a printed paper is deteriorated.

In order to prevent the "void phenomenon", JP-A-Hei-2-22668 proposes a toner to which an inorganic filler is added, JP-A-Hei-l-234857 proposes a toner containing a polyolefin wax, JP-A-Hei-4-328576 proposes a toner to which a thermoplastic resin grain is added, JP-A-Sho-59-129862 proposes mixing of an epoxy resin with a styrene/acrylic resin, and JP-A-Hei-4-250464 proposes mixing of an epoxy resin with a crystalline polyester. (The term "JP-A" as used herein means an "unexamined published Japanese patent application".) However, these approaches have still not provided satisfactory improved effects. In particular, there have been not provided any examples in which a styrene type resin is used as a main component for a binder resin.

SUMMARY OF THE INVENTION

An object of the present invention is to provide a toner which forms less void phenomenon on flash fixing and shows excellent fixing properties.

Another object of the present invention is to provide a toner which forms less image defects and shows excellent images properties such as an image density and fogging.

A further object of the present invention is to provide a toner which is, upon continuous printing, stable in image properties, image qualities and electrostatic properties and excellent in durability.

A still further object of the present invention is to provide a toner which shows excellent storage stability without solidification even when stored at a high temperature for a long period of time.

A still further object of the present invention is to provide a toner which shows excellent toner replenishing property from a vessel such as a bottle cartridge to a toner hopper for a replenisher and from a toner hopper for a replenisher to a development bath, and excellent toner conveyance in a development bath.

A still further object of the present invention is to provide a toner which forms less internal pollution of an optical system, a paper feeding system, etc., caused by the flying of a toner.

As a result of intensive studies, the present inventors have found that these objects are accomplished by the use of a resin having a specific molecular weight distribution, which improves miscibility and dispersibility with a coloring material, and thereby improves toner properties, thus completing the present invention.

In other words, the present invention provides a toner for flash fixation which comprises:

(i) a resin containing (a) a low molecular weight compound having the peak of molecular weight in 3,000 to 60,000 by gel permeation chromatography (GPC) and (b) a high molecular weight compound having the peak or shoulder of molecular weight in 80,000 to 1,000,000 by GPC, with the weight ratio of the low molecular weight compound to the high molecular weight compound of 97 to 60/3 to 40 and (ii) a coloring material, or (i) a resin containing (a) a low molecular weight compound having the peak of molecular weight (Lp) in 3,000 to 60,000 by GPC, (b) a middle molecular weight compound having the peak of molecular weight (Mp) in 5,000 to 100,000 by GPC and (c) a high molecular weight compound having the peak or shoulder of molecular weight (Hp) in 80,000 to 1,000,000 by GPC with Lp<Mp<Hp and (ii) a coloring material.

Also, the present invention provides a method for fixing a toner by flash fixation using a toner which comprises:

(i) a resin containing (a) a low molecular weight compound having the peak of molecular weight in 3,000 to 60,000 by gel permeation chromatography (GPC) and (b) a high molecular weight compound having the peak or shoulder of molecular weight in 80,000 to 1,000,000 by GPC with the weight ratio of the low molecular weight compound to the high molecular weight of 97 to 60/3 to 40 and (ii) a coloring material, or (i) a resin containing (a) a low molecular weight compound having the peak of molecular weight (Lp) in 3,000 to 60,000 by GPC, (b) a middle molecular weight compound having the peak of molecular weight (Mp) in 5,000 to 100,000 by GPC and (c) a high molecular weight compound having the peak or shoulder of molecular weight (Hp) in 80,000 to 1,000,000 by GPC with Lp<Mp<Hp and (ii) a coloring material.

DETAILED DESCRIPTION OF THE INVENTION

As the resin component (a low, middle or high molecular weight compound) to be incorporated in the toner of the present invention, there can be used various known materials suitable for use in a toner for developing electrostatic images.

Examples of such known materials include styrene type resins (including homopolymers or copolymers containing styrene or a styrene-substituted compound) such as polystyrene, chloropolystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylic ester copolymer (e.g., styrene-acrylic methyl copolymer, styrene-acrylic ethyl copolymer, styrene-acrylic butyl copolymer, styrene-acrylic octyl copolymer, styrene-acrylic phenyl copolymer), styrene-methacrylic ester copolymer (e.g., styrene-methacrylic methyl copolymer, styrene-methacrylic ethyl copolymer, styrene-methacrylic butyl copolymer, styrene-methacrylic phenyl copolymer), styrene-acrylic ester-methacrylic ester copolymer, styrene-α-chloroacrylic methyl copolymer and styrene-acrylonitrile-acrylic ester copolymer; vinyl chloride resins; rosin-modified maleic resins; phenolic resins; epoxy resins; saturated or unsaturated polyester resins; low molecular weight polyethylenes; low molecular weight polypropylenes; ionomer resins; polyurethane resins; silicone resins; ketone resins; ethylene-ethylacrylate copolymer resins; xylene resins; and polyvinyl butyral resins. Among these, preferred examples of resins which can be used in the present invention include styrene type resins, saturated or unsaturated polyester resins and epoxy resins. Specifically, particularly preferred are styrene, styrene-acrylic ester copolymer, styrene-methacrylic ester copolymer and styrene-acrylic ester-methacrylic ester copolymer. These resins can be used singly or in combination.

As the low molecular weight compound, a styrene type resin obtained by polymerizing 50 to 100 parts by weight of styrene with 50 to 0 parts by weight of acrylic ester and/or methacrylic ester is particularly preferred. As the middle molecular weight compound, a styrene type resin obtained by polymerizing 40 to 100 parts by weight of styrene with 60 to 0 parts by weight of acrylic ester and/or methacrylic ester is particularly preferred. As the high molecular weight compound, a styrene type resin obtained by polymerizing 40 to 95 parts by weight of styrene with 60 to 5 parts by weight of acrylic ester and/or methacrylic ester is particularly preferred.

<Resin of The First Embodiment>

In the following, a resin which contains (a) a low molecular weight compound having the peak of molecular weight in 3,000 to 60,000 by GPC and (b) a high molecular weight compound having the peak or shoulder of molecular weight in 80,000 to 1,000,000 by GPC with the weight ratio of the low molecular compound to the high molecular weight of 97 to 60/3 to 40, is explained.

The resin component used in the resin of the first embodiment has one or more peaks in the distribution of molecular weight, and which resin component may be partially crosslinked using a crosslinking agent. The resin of the first embodiment is composed of a high molecular weight compound and a low molecular weight compound wherein at least one peak of the low molecular weight compound (Lp) by GPC is present in 3,000 to 60,000 and at least one peak or shoulder of the high molecular weight compound (Hp) by GPC is present in 80,000 to 1,000,000 and the ratio of the low molecular weight compound to the high molecular weight compound is in the range of 97 to 60/3 to 40, preferably in the range of 95 to 70/5 to 30 by weight. If the peak of molecular weight of the low molecular weight compound is lower than 3,000, while it shows satisfactory fixation, it is liable to cause much toner spent and extreme toner fining in a developing machine, thereby causing unsatisfactory image quality and deteriorating the developer life. If the peak thereof is higher than 60,000, while it is hard to cause much toner spent and extreme toner fining, it unfavorably causes poor fixation on a printing paper on flash fixing. On the other hand, if the peak of molecular weight of the high molecular weight compound is lower than 80,000, while it shows satisfactory toner fixation on a printing paper, it is unfavorably liable to cause the void phenomenon in the toner layer. If the peak thereof exceeds 10,000,000, while it is hard to cause the void phenomenon, it unfavorably causes poor toner fixation on a printing paper. The GPC molecular weight of a resin is measured for a soluble content obtained by dissolving the resin in tetrahydrofuran. If the ratio of the low molecular weight compound exceeds 97 by weight, while it shows satisfactory toner fixation, the void phenomenon is unfavorably liable to be caused, the resulting toner becomes brittle, and since it is liable to cause much toner spent and extreme toner fining in a developing machine, when it is used for a long period of time, it increases flying a toner and fogging on a white base. If the ratio of the low molecular weight compound is lower than 60, while it is satisfactory in the durability of a developer and the preventing of void occurrence, it unfavorably causes poor toner fixation on a printing paper.

In the resin of the first embodiment, it is preferred that the low molecular weight compound has a softening point of 70° to 140° C. and the high molecular weight compound has a softening point of 100° to 160° C. If the softening point of the low molecular weight compound is less than 70° C., while it shows satisfactory fixation, it causes poor void resistance and poor dispersibility of internal additives such as a coloring material, thereby unfavorably impairing the image properties. If the softening point thereof is higher than 140° C. it unfavorably causes insufficient fixation. On the other hand, if the softening point of the high molecular weight compound is less than 100° C., it unfavorably causes poor void resistance. If the softening point thereof is higher than 160° C., it unfavorably causes unsatisfactory fixation.

<Resin of The Second Embodiment>

In the following, a resin which contains (a) a low molecular weight compound having the peak of molecular weight (Lp) in 3,000 to 60,000 by GPC, (b) a middle molecular weight compound having the peak of molecular weight (Mp) in 5,000 to 100,000 by GPC and (c) a high molecular weight compound having the peak or shoulder of molecular weight (Hp) in 80,000 to 1,000,000 by GPC with Lp<Mp<Hp, is explained.

The low molecular weight compound contained in the resin of the second embodiment has at least one peak (Lp) in 3,000 to 60,000 by GPC. The low molecular weight compound functions as a viscous component. If Lp is lower than 3,000, while it shows satisfactory fixation, it is liable to cause much toner spent and extreme toner fining in a developing machine, thereby causing unsatisfactory image quality and deteriorating the developer life. If Lp is higher than 60,000, while it is hard to cause much toner spent and extreme toner fining, it unfavorably causes poor fixation on a printing paper on flash fixing. It is preferred that the Lp is present in 3,500 to 40,000.

The middle molecular weight compound contained in the resin of the second embodiment functions as a viscous component. The middle molecular weight compound has at least one peak (Mp) in 5,000 to 100,000 by GPC. If Mp is lower than 5,000, while it shows satisfactory fixation, it is liable to cause much toner spent and extreme toner fining in a developing machine, thereby deteriorating the developer life. If Mp is higher than 100,000, while it is hard to cause much toner spent and extreme toner fining, it unfavorably causes poor toner fixation on a printing paper. It is preferred that the Mp is present in 5,500 to 80,000. If Mp is not present in 5,000 to 100,000, it deteriorates the miscibility of the low molecular weight compound with the high molecular weight compound, whereby the dispersibility of a coloring material and the like is decreased, thereby deteriorating the color tone of a toner.

The high molecular weight compound contained in the resin of the second embodiment functions as an elastic component. The high molecular weight compound has at least one peak or shoulder (Hp) in 80,000 to 1,000,000 by GPC. If Hp is lower than 80,000, while it shows satisfactory toner fixation on a printing paper, it is unfavorably liable to cause the void phenomenon in the toner layer. If Hp exceeds 1,000,000, while it is hard to cause the void phenomenon, it unfavorably causes poor toner fixation on a printing paper. It is preferred that the Hp is present in 90,000 to 800,000.

These resin components may have one or more peaks in the distribution of molecular weight, and which resin components may be partially crosslinked.

In the resin of the second embodiment, the weight ratio of the low molecular weight compound to the high molecular weight compound is preferably in the range of 95 to 35/5 to 65, more preferably in the range of 90 to 40/10 to 60. If the ratio of the low molecular weight compound exceeds 95 by weight, while it shows satisfactory toner fixation, the void phenomenon is unfavorably liable to be caused, the resulting toner becomes brittle, and since it is liable to cause much toner spent and extreme toner fining in a developing machine, when it is used for a long period of time, it increases flying a toner and fogging on a white base. In contrast, if the ratio thereof is lower than 35 by weight, while it is satisfactory in the durability of a developer and the preventing of void occurrence, it unfavorably causes poor toner fixation on a printing paper.

In the resin of the second embodiment, the weight ratio of (the total amount of the low molecular weight compound and the high molecular weight compound) to (the middle molecular weight compound) is preferably in the range of 3 to 65/97 to 35, more preferably in the range of 5 to 60/95 to 40. If the ratio of the middle molecular weight compound is higher than 97 by weight, while it shows satisfactory toner fixation on a printing paper, it is liable to cause voids and the resulting toner becomes brittle, thereby unfavorably deteriorating the durability. In contrast, if the ratio thereof is lower than 35 by weight, while it is satisfactory in the durability of a developer and the preventing of void occurrence, it unfavorably deteriorates the toner fixation.

In the resin of the second embodiment, the softening point of a low molecular weight compound is preferably 60 to 130° C. If the softening point thereof is lower than 60° C., it is unfavorably liable to cause much toner spent and extreme toner fining in a developing machine. If the softening point thereof is higher than 130° C., it deteriorates the fixation on a printing paper. The softening point of a middle molecular weight compound is preferably 70° to 140° C. If the softening point thereof is lower than 70° C., it unfavorably causes poor void resistance and poor dispersibility of internal additives in a toner, thereby impairing the image properties. The softening point of a high molecular weight compound is preferably 90° to 170° C. If the softening point thereof is lower than 90° C. it is unfavorably liable to cause the void phenomenon, and if the softening point thereof is higher than 170° C., it unfavorably deteriorates the fixation on a printing paper and the productivity of a toner.

In the resin of the second embodiment, a resin containing a high molecular weight compound, a middle molecular weight compound and a low molecular weight compound, the content of the high molecular weight compound is preferably 40 wt % or less, more preferably 35 wt% or less. If the content thereof is 40 wt% or less, the toner is satisfactory in the fixation.

In the present invention, it is preferred to preliminary prepare a resin which contains at least a low molecular weight compound and a high molecular weight compound in a stage of producing a resin (for example, at the polymerization stage). For instance, (i) a resin made of a low molecular weight compound and a high molecular weight compound which is prepared by mixing the low molecular weight compound and the high molecular weight compound in the condition of a solution, an emulsion or a suspension with (ii) a resin which contains a middle molecular weight compound, are prepared, respectively, at the polymerization stage, then a toner may be prepared by mixing these. In this case, the softening point of a resin which contains a low molecular weight compound and a high molecular weight compound is preferably 100° to 160° C. If the softening point thereof is lower than 100° C., it is unsatisfactory in the void resistance. If the softening point thereof is higher than 160° C., it is unsatisfactory in the fixation In cases of using such a resin, if Mp is less than Lp or Mp is larger than Hp, internal additives such as a coloring material are unable to be fully dispersed in the toner production, then it is liable to cause a phase separation, thereby increasing pollution in a machine due to the toner flying caused by the shortage of hiding power and the disproportion of the toner charge distribution, and results in increased fogging. Accordingly, in cases where Mp is positioned in Lp<Mp<Hp, the miscibility is satisfactory .on the toner production and the uniform dispersibility can be obtained.

The resin used in the present invention can be produced by a known solution polymerization, suspension polymerization, bulk polymerization, emulsion polymerization, etc. In view of the odor of a toner on flash fixing, the total amount of a low boiling point component such as remaining monomers in the toner and remaining solvents is 2,000 ppm or less, more preferably 1,000 ppm or less.

Other resins may be mixed with the resin used in the present invention. The amount of the other resins is preferably 30 wt % based on the total amount of the resin. Examples of other resins include rosin-modified maleic acid resins, phenolic resins, silicone resins, ketone resins, epoxy resins, low molecular weight polyethylenes, low molecular weight polypropylenes, ionomer resins, polyester resins, xylene resins, polyvinyl butyral resins, butadiene resins, polycarbonate resins, etc. These resins can be used singly or in combination.

Any conventionally available coloring materials can be used in the present invention. Any suitable pigments or dyes are usable. Examples thereof include titanium oxide, zinc white, alumina white, calcium carbonate, Prussian blue, carbon black, phthalocyanine blue, phthalocyanine green, Hansa yellow G, rhodamine type dyes or pigments, chrome yellow, quinacrine, benzidine yellow, rose bengal, triallylmethane type dyes, anthraquinone dyes, monoazo- or disazo type dyes or pigments. These can be used singly or in combination. The coloring material is used in such an amount sufficient for coloring a toner to form a visible image by development. For instance, it is preferred to add 1 to 20 parts by weight of a coloring material per 100 parts by weight of a resin.

Furthermore, in order to adjust the chargeability of a toner, nigrosine type dyes, quaternary ammonium salt compounds, triamonitriphenylmethane type compounds, imidazole compounds and the like charge controlling agents may be added to a positive charge type toner, and metal-containing azo type dyes, salicylic acid metal complexes, alkyl salicylate metal complexes and the like charge controlling agents may be added to a negative charge type toner. It is preferred to added about 0.05 to 10 parts by weight of a charge controlling material per 100 parts by weight of a resin.

Furthermore, in order to improve the fluidity and anti-agglomeration of a toner, it is preferred that an inorganic fine powder is contained at least on the surface of a toner. As an inorganic fine powder, it is preferred to use a metal oxide prepared by a known wet or dry process, e.g., titania, silica, alumina, magnesium oxide, zinc oxide and the like fine powder. These can be used singly or in combination. It is suitable to use at least a silica fine powder.

Furthermore, the surface of an inorganic fine powder may be treated with a silane coupling agent, a silicone oil, etc., for reforming the hydrophobic nature and the chargeability.

The surface treatment of an inorganic fine powder with a silane coupling agent can be conducted by a conventionally known method. Examples of the silane coupling agent include, e.g., organoalkoxysilanes (e.g., methoxytrimethylsilane, dimethoxydimethylsilane, trimethoxymethylsilane, ethoxytrimethylsilane), organochlorosilanes (e.g., trichloromethylsilane, dichlorodimethylsilane, chlorotrimethylsilane, trichloroethylsilane, dichlorodiethylsilane, chlorotriethylsilane, trichlorophenylsilane), organosilazanes (e.g., triethylsilazane, tripropylsilazane, triphenylsilazane, hexamethyldisilazane, hexaethyldisilazane, hexaphenyldisilazane), organodisilanes, organosilanes, etc. These can be used singly or in combination. It is preferred to use organochlorosilanes and organosilazanes.

The surface treatment of an inorganic fine powder with a silicone oil can be conducted by a conventionally known method. Examples of the silicone oil include, e.g., general straight silicone oils (e.g., dimethyl silicone oil, methylphenyl silicone oil, methylhydrogen silicone oil) and modified silicone oils (e.g., methacryl modified silicone oil, alkyl modified silicone oil, epoxy modified silicone oil, amino modified silicone oil). These can be used singly or in combination. It is preferred to use straight silicone oils.

The specific surface area of an inorganic fine powder is preferably 20 to 700 $m^2/g$, more preferably 50 to 500 $m^{2/}g$. If the specific surface area is less than 20 $m^2/g$, it is insufficient to impart the fluidity to a toner, whereby the toner conveyance in a development bath is deteriorated, which causes deterioration of the frictional charge function with a carrier or the doctor blade portion, thereby deteriorating the fogging and increasing the flying of a toner. If the specific surface area is higher than 700 $m^2/g$, the bulkhead effect of toner gains disappears, which deteriorates the storage stability at a high temperature and which is liable to agglomerate inorganic fine powders, thereby deteriorating the handleability and the uniform dispersion on the surface of a toner.

The amount of an inorganic fine powder is used in the range of 0.01 to 8 parts by weight, preferably 0.05 to 5 parts by weight, based on 100 parts by weight of a toner grain. If it is less than 0.01 parts by weight, no improvement in the flowability appear, thereby deteriorating the toner conveyance in a development bath and the storage stability at high temperature. If it is more than 8 parts by weight, a part of flying inorganic fine powders may cause the filming of a photoreceptor or may cause the attachment to a carrier or in a developing machine, thereby unfavorably bringing about deterioration of the charging function, etc.

In addition, as external additives for a toner, known fine powders such as magnetite, ferrite, conductive titanium, antimony oxide, tin oxide, cerium oxide, hydrotalcites, acrylates may be added for the purpose of a resistance controlling agent, an abrasive agent, etc. Preferably, such are added in an amount of 0,005 to 5 parts by weight per 100 parts by weight of a toner.

The BET specific surface area of an inorganic fine powder is determined by a commercially available BET specific surface area measuring apparatus by nitrogen adsorption, e.g., Flowsob type 2300 (a fluidized type specific surface area automatic measuring machine manufactured by Shimadzu Corp.).

Furthermore, various plasticizers and auxiliaries such as olefinic wax may be added to a toner for the purpose of adjusting thermal characteristics, physical properties, etc. Preferably, such are added in an amount of 0.1 to 10 parts by weight per 100 parts by weight of a resin.

If the toner of the present invention is used for a two-component system developer, it may be used in admixture with a magnetic carrier. The content proportion of a carrier to a toner in the developer is preferably in the range of 100/1 to 10 by weight. As such a magnetic carrier, there can be used a known material such as iron powder, ferrite powder, magnetite powder and magnetic resin carrier each having a grain diameter of about 30 to 200 μm. Such a magnetic carrier may be coated with a known silicone resin, acrylic resin, fluorine resin or a mixture thereof. Alternatively, the toner of the present invention may be used as a magnetic one-component system toner containing a magnetic material (e.g., magnetite) or a non-magnetic one-component system toner free of magnetic material for use in a one-component system developer.

The preparation of the toner grains of the present invention can be accomplished by various toner preparation methods which have heretofore been employed. Examples of such toner preparation methods include those described hereinafter. Specifically, a resin, a coloring material, a charge controlling agent, etc., are uniformly dispersed by means of a known mixer. The resulting dispersion may be melt-kneaded by means of an enclosed kneader or monoaxial or biaxial extruder, then cooled, ground, and classified. As a kneading machine, in view of superiority in the continuous production, etc., there have been mainly used monoaxial or biaxial extruders in recent years. Examples thereof include a Type KTK biaxial extruder available from Kobe Steel, Ltd., a Type TEM biaxial extruder available from Toshiba Machine Co., Ltd., a biaxial extruder available from K.C.K. Co., a Type PCM biaxial extruder available from Ikegai Corp., and a co-kneader available from Bus Corp. The average grain diameter of a toner is preferably from 3 to 20 μm.

The softening point (Tm) of a toner is generally from 70° to 150° C., preferably from 80° to 140° C. in view of the fixation of a toner and the durability of a developer, though it varies on the flash energy amount, irradiation time, irradiation method, etc.

The glass transition temperature (Tg) of a toner is preferably 45° C. or higher. If it is lower than 45° C., the toner is susceptible to agglomeration or fixing when allowed to stand at an elevated temperature as high as 40° C. for a prolonged period of time.

In the case of treating a toner with external additives, a classified toner and an external additive are stirred and mixed with a high speed stirrer (e.g., super mixer, Henschel mixer). If necessary, the kind and/or amount of external additives may be changed depending on if the toner is for use in a starting developer or replenisher.

In the present invention, an inorganic fine powder is added to a toner, followed by stirring and mixing. The mixing conditions such as the stirring number of revolutions and period of time can be properly determined depending on the toner properties. In order to decrease agglomeration, the inorganic fine powder is preferably subjected to preliminary grinding treatment before the external addition. The inorganic fine powder may be separately added depending on the kind, amount and mixing conditions. After the external addition, when the flying of external additives is present in a toner, they are removed using a vibrating sieve, etc., if necessary.

The test methods for a resin used in the present invention are described hereinafter.

<Method of Molecular Weight Determination>

The peak of molecular weight of a resin is determined by gel permeation chromatography (GPC) as follows:

After a resin is dissolved in tetrahydrofuran to have 0.1 wt % of a soluble content, insoluble contents are removed to prepare a sample solution. 100 μl of the sample solution is injected to determine the molecular weight with flowing 0.5 ml or 1 ml per minute of a solvent (tetrahydrofuran). The determination conditions are selected in such a manner that the molecular weight distribution of the sample solution is included within a range showing linearity of the calibration curve (the logarithm of a molecular weight v.s. the count number) prepared by several monodisperse polystyrene standard solutions. In this determination, the reliability is confirmed when an NBS706 polystyrene standard sample ($Mw=28.8\times10^4$, $Mn=13.7\times10^4$, $Mw/Mn=2.11$) shows $Mw/Mn=2.11\pm0.10$. In a similar manner, the molecular weight of a resin in a toner can be determined. Also, the weight ratio of each resin components in a toner may be calculated using the peak area by GPC.

<Glass Transition Temperature: Tg>

Using-the curve determined at a heating rate of 10° C./min obtained by a differential thermal analyzer (DTA-40 of Shimadzu Corp.), the glass transition temperature is determined as a temperature on the intersection of the transition (inflection) starting point and the tangent line thereof.

<Softening Point: Tm>

Using a flow tester (CFT-500 of Shimadzu Corp.), determination is conducted using 1 g of a sample under the conditions of nozzle: 1 mm×10 mm, load: 30 kg, preheating time: 5 min at 50° C. and heating rate: 3° C./min Then, the softening point is determined as a temperature on the middle point of the distance from the flow starting point to the termination thereof.

The present invention will be further described in the following examples, but the present invention should not be construed as being limited thereto. The term "parts" as used herein indicates "parts by weight".

In the following examples, styrene-acrylate copolymer A prepared by suspension polymerization was used as a low molecular weight compound and styrene-acrylate copolymer B prepared by solution polymerization was used as a high molecular weight compound.

Styrene-Acrylate Copolymer A

Styrene/n-butyl acrylate=85/15 by parts

Tm=115° C., Lp=10,000, Tg=64° C.

Styrene-Acrylate Copolymer B

Styrene/n-butyl acrylate=90/10 by weight

Tm=135° C., Hp=400,000, Tg=60° C.

EXAMPLE 1

| | |
|---|---|
| Styrene-Acrylate Copolymer A | 80 parts |
| Styrene-Acrylate Copolymer B | 20 parts |
| Coloring material: Carbon black MA100 (available from Mitsubishi Kasei Corp.) | 8 parts |
| Charge controlling agent: Spiron black TRH (available from Hodogaya Chemical Co., Ltd.) | 1 part |

These components were blended, kneaded by means of a continuous extruder, ground, and then classified to obtain a black toner having an average grain diameter of 11 μm. To 100 parts of the resulting black toner were added 0.2 parts of silica powder (R972 available from Nippon Aerosil K.K) by means of a Henschel mixer. Then, 6 parts of the black toner thus obtained and 94 parts of a resin carrier containing a magnetite powder having an average grain diameter of 40 to 50 μm to prepare a developer.

Using a laser printer according to the reverse development system having an organic photoconductor as a photoreceptor, a printed image (printed rate: 100 mm/sec) was flash-fixed on a plain copying paper in a fixing part equipped with a xenon lamp.

Then, with respect to the toner contained in the developer, the fixing properties and the image properties were evaluated.

With respect to the void resistance, the void generating ratio was calculated by dividing the number of non-void letters by the total number of printed letters, in which A indicated 97% or more, B indicated less than 97% to 90% or more and C indicated less than 90% of the void generating ratio.

The results are shown in Table 1.

From the results, it was satisfactory in the fixing strength and the void resistance. Also, no problem was observed in the image properties.

EXAMPLES 2 AND 3 AND COMPARATIVE EXAMPLES 1 AND 2

Each developers was prepared in the same manner as in Example 1, except that the mixing ratio of styrene-acrylate copolymers A and B was changed as set forth in Table 1, respectively.

Then, the toner properties were evaluated.

The results are shown in Table 1.

TABLE 1

| | Copolymer A (Low Mol. Wt.) (parts) | Copolymer B (High Mol. Wt.) (parts) | Toner Tm (°C.) | Toner Tg (°C.) | Fixing Properties: Void resistance | Fixing Properties: Fixing strength | Image Properties: Image density | Image Properties: Fogging |
|---|---|---|---|---|---|---|---|---|
| Example 1: | 80 | 20 | 119 | 63 | A | Good | Good | Good |
| Example 2: | 55 | 45 | 124 | 62 | A | Almost good | Good | Good |
| Example 3: | 95 | 5 | 116 | 64 | B | Good | Good | Almost good |
| Comparative Example 1: | 100 | 0 | 115 | 64 | C | Good | Good | Poor |
| Comparative Example 2: | 0 | 100 | 135 | 60 | A | Poor | Almost good | Good |

EXAMPLE 4

Styrene-Acrylate Copolymer C 100 parts

Low molecular weight components (LMWC):

Styrene/n-butylacrylate=80/20 by weight

High molecular weight components (HMWC):

Styrene/n-butylacrylate=75/25 by weight

Lp=10,000, Hp=400,000

Mixing ratio of LMWC/HMWC=70/30 by weight

A developer was prepared in the same manner as in Example 1, except that styrene-acrylate copolymer C was used in place of copolymers A and B.

Then, the fixing properties and the image properties were evaluated.

The results are shown in Table 2.

From the results, it was satisfactory in the void resistance. Also, it was almost satisfactory in the fixing strength, showing the adhesive properties of a toner on paper.

EXAMPLES 5 AND 6 AND COMPARATIVE EXAMPLES 3 AND 4

Each developers was prepared in the same manner as in Example 4, except that, in place of copolymer C, styrene-acrylate copolymers D, E, F and G (in which the mixing ratio of low and high molecular weight components of copolymer C was changed as set forth in Table 2) were used, respectively.

Then, the toner properties and the image properties were evaluated.

The results are shown in Table 2.

EXAMPLE 7

Styrene-Acrylate Copolymer H 100 parts

Low molecular weight components (LMWC):

Styrene/n-butylacrylate=90/10 by weight

High molecular weight components (HMWC):

Styrene/n-butylacrylate=75/25 by weight

Lp=5,000, Hp=800,000

Mixing ratio of LMWC/HMWC=80/20 by weight

A developer was prepared in the same manner as in Example 1, except that styrene-acrylate copolymer H was used in place of copolymers A and B.

Then, the fixing properties and the image properties were evaluated.

The results are shown in Table 2, in which it was satisfactory in all results.

COMPARATIVE EXAMPLE 5

Styrene-Acrylate Copolymer I 100 parts

Low molecular weight components (LMWC):

Styrene/n-butylacrylate=79/21 by weight

High molecular weight components (HMWC):

Styrene/n-butylacrylate=75/25 by weight

Lp=70,000, Hp=400,000

Mixing ratio of LMWC/HMWC=90/10 by weight

A developer was prepared in the same manner as in Example 1, except that styrene-acrylate copolymer I was used in place of copolymers A and B. The grindability of the toner was poor, and the productivity was not good slightly.

Then, the fixing properties and the image properties were evaluated as shown in Table 2, in which the fixing strength was poor.

TABLE 2

| | Copolymer | Peak of M.W. (Low Mol. Wt.) | Peak of M.W. (High Mol. Wt.) | LMWC/HMWC (by weight) | Toner Tm (°C.) | Toner Tg (°C.) | Fixing properties: Void resistance | Fixing properties: Fixing strength | Image Properties: Image density | Image Properties: Fogging |
|---|---|---|---|---|---|---|---|---|---|---|
| Ex. 4: | C | 10,000 | 400,000 | 70/30 | 127 | 61 | A | Almost good | Good | Good |
| Ex. 5: | D | 10,000 | 400,000 | 90/10 | 120 | 61 | A | Good | Good | Good |
| Ex. 6: | E | 10,000 | 400,000 | 95/5 | 117 | 60 | B | Good | Good | Almost good |
| Comp. Ex. 3: | F | 10,000 | 400,000 | 50/50 | 134 | 62 | A | Poor | Good | Good |
| Comp. | G | 10,000 | none | 100/0 | 115 | 60 | C | Good | Almost | Poor |

TABLE 2-continued

| | Copolymer | Peak of M.W. (Low Mol. Wt.) | Peak of M.W. (High Mol. Wt.) | LMWC/HMWC (by weight) | Toner Tm (°C.) | Toner Tg (°C.) | Fixing properties: Void resistance | Fixing properties: Fixing strength | Image Properties: Image density | Image Properties: Fogging |
|---|---|---|---|---|---|---|---|---|---|---|
| Ex. 4: | | | | | | | | | good | |
| Ex. 7: | H | 5,000 | 800,000 | 80/20 | 130 | 61 | A | Good | Good | Good |
| Comp. Ex. 5: | I | 70,000 | 400,000 | 90/10 | 140 | 64 | A | Poor | Slightly poor | Good |

Notes:
LMWC = Low Molecular Weight Copolymer
HMWC = High Molecular Weight Copolymer

EXAMPLE 8

Styrene-Acrylate Copolymer J 10 parts

Low molecular weight components (LMWC):

Styrene=100 by weight

High molecular weight components (HMWC):

Styrene/n-butylacrylate=75/25 by weight

Lp=5,000, Hp=400,000

Mixing ratio of LMWC/HMWC=50/50 by weight

Tm=130° C., Tg=61° C.

(Copolymer J was prepared by stirring and mixing the low molecular weight copolymer (by bulk polymerization) with the high molecular weight copolymer (by solution polymerization) in a solvent.)

Styrene-Acrylate Copolymer K 90 parts

Styrene/n-butylacrylate=75/25 by weight

Mp=20,000, Tm=115° C., Tg=60° C.

(Copolymer K was prepared by suspension polymerization.)

A developer was prepared in the same manner as in Example 1, except that styrene-acrylate copolymers J and K were used in place of copolymers A and B.

High molecular weight components (HMWC):

Styrene/n-butylacrylate=75/25 by weight

Mp=15,000, Hp=500,000

Mixing ratio of MMWC/HMWC=65/35 by weight

Tm=132° C., Tg=62° C.

(Copolymer L was prepared by stirring and mixing the middle molecular weight-copolymer with the high molecular weight copolymer (each by solution polymerization) in a solvent.)

Styrene-Acrylate Copolymer M 70 parts

Styrene/n-butylacrylate=90/10 by weight

Lp=6,000, Tm=105° C., Tg=59° C.

(Copolymer M was prepared by suspension polymerization.)

Each developers was prepared in the same manner in Example 8, except that, in place of copolymers J and K, styrene-acrylate copolymers L and M were used with changing their mixing ratio as set forth in Table 3. In these examples, the mixing ratio of the low/high molecular weight copolymers was about 87/13 and that of (the total amount of low and high molecular weight copolymers)/(the middle molecular weight copolymer) was about 80/20.

The results are shown in Table 3.

TABLE 3

| | Copolymer mixing ratio (by weight) | Toner Tm (°C.) | Toner Tg (°C.) | Fixing Properties: Void resistance | Fixing Properties: Fixing strength | Image Properties: Image density | Image Properties: Fogging | Pollution in machine (Toner flying) |
|---|---|---|---|---|---|---|---|---|
| Ex. 8: | J/K = 10/90 | 116 | 60 | B | Good | Good | Good | Good |
| Ex. 9: | J/K = 20/80 | 118 | 60 | A | Good | Good | Very good | Very good |
| Ex. 10: | J/K = 50/50 | 112 | 61 | A | Almost good | Good | Very good | Very good |
| Comp. Ex. 6: | J/K = 0/100 | 115 | 60 | C | Good | Almost good (slightly higher) | Poor | Slightly poor |
| Ex. 11: | L/M = 30/70 | 113 | 60 | B | Good | Good | Almost good | Almost good |

Then, the fixing properties and the image properties were evaluated. Also, pollution in the machine was observed.

The results are shown in Table 3.

EXAMPLE 9 AND 10 AND COMPARATIVE EXAMPLE 6

Styrene-Acrylate Copolymer L 30 parts

Middle molecular weight components (MMWC):

Styrene/n-butylacrylate=82/18 by weight

As described above, the toner of the present invention is excellent in the fixing strength and the void resistance, the use of the toner of the present invention provides an excellent image in the image quality, the image density and fogging, etc., and exhibits stable image properties such as little change in the image quality during long run continuous printing, and further provides less pollution in the machine caused by toner flying. Thus, the toner of the present invention provides a great industrial advantage.

While the invention has been described in detail and with reference to specific embodiments thereof, it will be apparent to one skilled in the art that various changes and modifications can be made therein without departing from the spirit and scope thereof.

What is claimed is:

1. A toner for flash fixation which comprises: (i) a resin containing (a) a low molecular weight compound having a peak in molecular weight distribution at 3,000 to 60,000 measured by gel permeation chromatography and (b) a high molecular weight compound having a peak or shoulder in molecular weight distribution at 80,000 to 1,000,000 measured by gel permeation chromatography, wherein the low molecular weight compound and the high molecular weight compound are the same kind of resin and are selected from the group consisting of a styrene resin, a polyester resin and an epoxy resin, with the weight ratio of said low molecular weight to said high molecular weight compound being in the range of 97 to 60/3 to 40; and (ii) a coloring material.

2. A toner for flash fixation which comprises:

(i) a resin containing (a) low molecular weight compound having a peak in molecular weight distribution (Lp) at 3,000 to 60,000 measured by gel permeation chromatography, (b) a medium molecular weight compound having a peak in molecular weight distribution (Mp) at 5,000 to 100,000 measured by gel permeation chromatography and (c) a high molecular weight compound having a peak in molecular weight distribution (Hp) at 80,000 to 1,000,000 measured by gel permeation chromatography, with the condition of Lp<Mp<Hp being met; and (ii) a coloring material.

3. The toner for flash fixation as claimed in claim 2, wherein the weight ratio of said low molecular weight compound to said high molecular weight compound is from 95 to 35/5 to 65 and the weight ratio of (the total amount of said low molecular weight compound and said high molecular weight compound) to (said medium molecular weight compound) is from 3 to 65/97 to 35.

4. The toner for flash fixation as claimed in claim 2, wherein said resin is selected from the group consisting of a styrene type resin, a polyester resin and an epoxy resin.

5. The toner for flash fixation as claimed in claim 1 or 2, wherein said resin is selected from the group consisting of a polystyrene, a styrene-acrylate copolymer, a styrene-methacrylate copolymer and a styrene-acrylate-methacrylate copolymer.

6. The toner for flash fixation as claimed in claim 1 or 2, wherein an inorganic fine powder is contained at least on the surface of said toner.

7. The toner for flash fixation as claimed in claim 1 or 2, wherein the softening point of said toner is from 70° to 150° C.

8. The toner for flash fixation as claimed in claim 1 or 2, wherein the glass transition temperature of said toner is 45° C. or higher.

9. A method for fixing a toner by flash fixation using a toner which comprises: (i) a resin containing (a) a low molecular weight compound having a peak in molecular weight distribution at 3,000 to 60,000 measured by gel permeation chromatography and (b) a high molecular weight compound having a peak or shoulder in molecular weight distribution at 80,00 to 1,000,000 measured by gel permeation chromatography, wherein the low molecular weight compound and the high molecular weight compound are the same king of resin and are selected from the group consisting of a styrene resin, a polyester resin and an epoxy resin, with the weight ratio of said low molecular weight to said high molecular weight compound being in the range of 97 to 60/3 to 40; and (ii) a coloring material.

10. A method for fixing a toner by flash fixation using a toner which comprises: (i) a resin containing (a) a low molecular weight compound having a peak in molecular weight distribution (Lp) at 3,000 to 60,000 measured by gel permeation chromatography, (b) a medium molecular weight compound having a peak in molecular weight distribution (Mp) at 5,000 to 100,000 measured by gel permeation chromatography and (c) a high molecular weight compound having a peak in molecular weight distribution (Hp) at 80,000 to 1,000,000 measured by gel permeation chromatography, with the condition of Lp<Mp<Hp being met; and (ii) a coloring material.

11. The method for fixing a toner by flash fixation as claimed in claim 10, wherein the weight ratio of said low molecular weight compound to said high molecular weight compound is from 95 to 35/5 to 65 and the weight ratio of (the total amount of said low molecular weight compound and said high molecular weight compound) to (said medium molecular weight compound) is from 3 to 65/97 to 35.

12. The method for fixing a toner by flash fixation as claimed in claim 10, wherein said resin is selected from the group consisting of a styrene type resin, a polyester resin and an epoxy resin.

13. The method for fixing a toner by flash fixation as claimed in claim 9 or 10, wherein said resin is selected from the group consisting of a polystyrene, a styrene-acrylate copolymer, a styrene-methacrylate copolymer and a styrene-acrylate-methacrylate copolymer.

14. The method for fixing a toner by flash fixation as claimed in claim 9 or 10, wherein an inorganic fine powder is contained at least on the surface of said toner.

15. The method for fixing a toner by flash fixation as claimed in claim 9 or 10, wherein the softening point of said toner is from 70° to 150° C.

16. The method for fixing a toner by flash fixation as claimed in claim 9 or 10, wherein the glass transition temperature of said toner is 45° C. or higher.

17. The toner for flash fixation as claimed in claim 1, which toner exhibits low void phenomenon on flash fixing.

18. The toner for flash fixation as claimed in claim 2, which toner exhibits low void phenomenon on flash fixing.

19. The method for fixing a toner by flash fixation as claimed in claim 9, wherein said toner exhibits low void phenomenon on flash fixing.

20. The method for fixing a toner by flash fixation as claimed in claim 10, wherein said toner exhibits low void phenomenon on flash fixing.

* * * * *